US005735106A

United States Patent [19]

Burda et al.

[11] Patent Number: 5,735,106

[45] Date of Patent: Apr. 7, 1998

[54] CONTINUOUS PROCESS FOR PACKAGING COMPRESSIBLE PRODUCTS

[75] Inventors: Timothy Paul Burda, Cincinnati; William Scott Andes, Springfield, both of Ohio

[73] Assignee: The Procter & Gamble company, Cincinnati, Ohio

[21] Appl. No.: 756,753

[22] Filed: Nov. 26, 1996

[51] Int. Cl.[6] ..... B65B 1/24; B65B 13/20; B65B 9/06; B65B 51/26

[52] U.S. Cl. ..... 53/413; 53/479; 53/450; 53/463; 53/526; 53/528; 53/436

[58] Field of Search ..... 53/450, 451, 463, 53/479, 436, 413, 134.1, 550, 526, 528, 477, 374.3, 374.4

[56] References Cited

U.S. PATENT DOCUMENTS

| | | | |
|---|---|---|---|
| 3,537,226 | 11/1970 | Le Van et al. | 53/436 |
| 4,592,193 | 6/1986 | Gustavsson | 53/530 |
| 4,949,899 | 8/1990 | Stone | 229/125.09 |
| 5,014,497 | 5/1991 | McMahon | 53/451 |
| 5,154,343 | 10/1992 | Stone | 229/225 |
| 5,161,734 | 11/1992 | Ruehl et al. | 229/227 |
| 5,236,123 | 8/1993 | Stone et al. | 229/225 |
| 5,265,799 | 11/1993 | Stone | 229/225 |
| 5,314,114 | 5/1994 | Stone | 229/225 |
| 5,366,141 | 11/1994 | Stone | 229/120.03 |
| 5,425,216 | 6/1995 | Ausnit | 53/451 |
| 5,439,133 | 8/1995 | Stone | 220/418 |
| 5,505,374 | 4/1996 | Stone | 229/227 |
| 5,515,996 | 5/1996 | Stone | 220/416 |

FOREIGN PATENT DOCUMENTS

| | | | |
|---|---|---|---|
| 94/22731 | 10/1994 | WIPO | B65D 71/06 |
| 94/22739 | 10/1994 | WIPO | B65D 71/06 |

*Primary Examiner*—Horace M. Culver
*Assistant Examiner*—John Paradiso
*Attorney, Agent, or Firm*—William Scott Andes; E. Kelly Linman; Jacobus C. Rasser

[57] ABSTRACT

In accordance with the present invention, products are contained within a continuous cylindrical sleeve in a low- or no-tension condition. Products are captured within the sleeve during its formation. The sleeve forms a continuous path encircling the product(s) in at least one plane through the products and package, defining an axial direction normal to the plane and a circumferential direction around the product(s) within the plane. One or more axially-extending pleats are unitarily formed from the material comprising the cylindrical wall of the sleeve, such that the circumference of the cylindrical sleeve is reduced. By reducing the circumference of the cylinder the interior volume of the sleeve, and thus the finished package, is reduced, thus subjecting the products within the package to a compressive force. The compressive force is imparted by a uniform reduction in circumference resulting in a uniform inwardly-directed product compression. Where a single pleat is formed so as to uniformly reduce the circumference of the sleeve, the reduction in circumference is approximately equal to the finished width of the pleat. Multiple pleats multiply the reduction in circumference.

20 Claims, 3 Drawing Sheets

CONTINUOUS PROCESS FOR PACKAGING COMPRESSIBLE PRODUCTS

FIELD OF THE INVENTION

The present invention relates to an improved process for producing packages which may be used for efficiently packaging and shipping compressible products. The present invention further relates to such a process which may be practiced on a continuous basis.

BACKGROUND OF THE INVENTION

When transporting finished products from the point of manufacture to the point of sale, or to an intermediate storage facility, it is often desirable to enclose a plurality of products within a larger, more durable package. Not only does this preserve the products in their desired, saleable condition, but it minimizes the number of individual items to be handled and generally provides more uniformly shaped items for stacking and handling.

Through the years such packages have frequently taken the form of conventional, often rectangular, rigid or semi-rigid packages formed of corrugated or non-corrugated cardboard having dimensions suitable for enclosing a predetermined number of finished products. For other products requiring protection from contamination but not from physical harm, "soft" flexible packaging materials such as polymeric films and papers of varying thicknesses have been employed in similar fashion. While such packages have proven effective in protecting the finished products during transport and storage, they are generally inefficient in terms of space occupied and material required for transporting and storing compressible products having a significant void volume within.

In an effort to address this shortcoming, various methods have been devised for subjecting compressible products to compressive forces prior to their loading into a package such that the package holds them under tension until it is opened. Although an improvement over conventional packaging methods, this approach frequently requires complex machinery to compress the product(s) and to maintain them in a compressed state during their insertion into a pre-formed package or while a package is secured around them. Moreover, in many instances some portion of the compression is lost due to the volume occupied by the compression apparatus which is vacated when the machinery is withdrawn from the package.

Another approach for packaging compressible products has been to combine the compression process with the package fabrication process such that the package seal is formed while external compression forces are applied to the products and surrounding package components. While this approach addresses the compression-loss issue discussed above with regard to within-the-package product compression apparatus, there remains the problem of forming an adequate package seal or joint under tension.

Accordingly, it would be desirable to provide a package which is suitable for efficiently packaging and shipping compressible products. It would be further desirable to provide a continuous process for readily and economically forming such packages.

SUMMARY OF THE INVENTION

In accordance with the present invention, products are contained within a continuous cylindrical sleeve in a low- or no-tension condition. Products are captured within the sleeve during its formation. The sleeve forms a continuous path encircling the product(s) in at least one plane through the products and package, defining an axial direction normal to the plane and a circumferential direction around the product(s) within the plane. One or more axially-extending pleats are unitarily formed from the material comprising the cylindrical wall of the sleeve, such that the circumference of the cylindrical sleeve is reduced. By reducing the circumference of the cylinder the interior volume of the sleeve, and thus the finished package, is reduced, thus subjecting the products within the package to a compressive force. The compressive force is imparted by a uniform reduction in circumference resulting in a uniform inwardly-directed product compression. Where a single pleat is formed so as to uniformly reduce the circumference of the sleeve, the reduction in circumference is approximately equal to the finished width of the pleat. Multiple pleats multiply the reduction in circumference.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
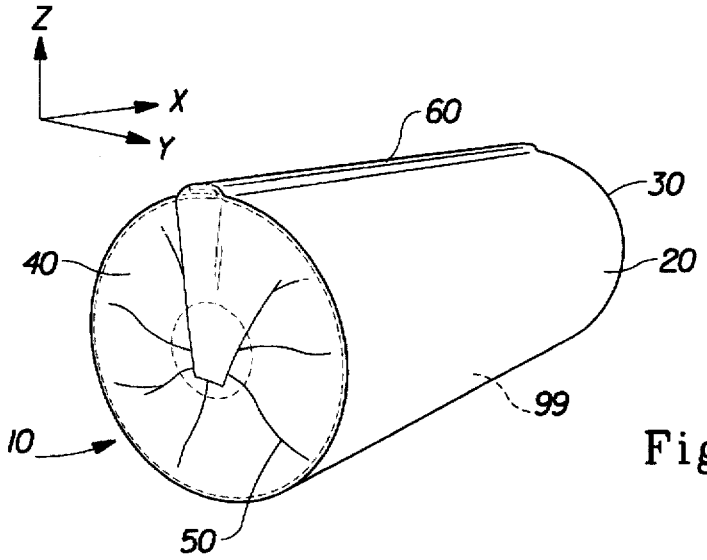
FIG. 1 is a perspective view of a package according to the present invention in a fully assembled condition.

FIG. 1 illustrates a package 10 constructed in accordance with the present invention. Package 10 comprises a sleeve portion 20, package ends 30 and 40, a pleat 60, end seals 50, and encloses a representative product 99. Package 10 is constructed in accordance with the process of the present invention such that the product 99 is maintained in a substantially uniform state of circumferential compression in a plane passing through the product in a direction normal to the axial direction defined by the product ends. Package 10 is formed from a flexible packaging material such as polymeric film or kraft paper, for example. Accordingly, the package is not fabricated from a pre-formed "blank" but is instead formed from a length of a stock material. Accordingly, the package is assembled, folded, and wrapped about the product and assumes the general shape of the product. The material is then pleated to form pleat 60, reducing the circumference of the sleeve about the product in at least one plane and imparting compressive forces thereto. Since the material is flexible, the pleats may be folded into the package ends 30, 40 and sealed into ends seals 50 without undue difficulty to effect a closure means for the package.

Figure 2:
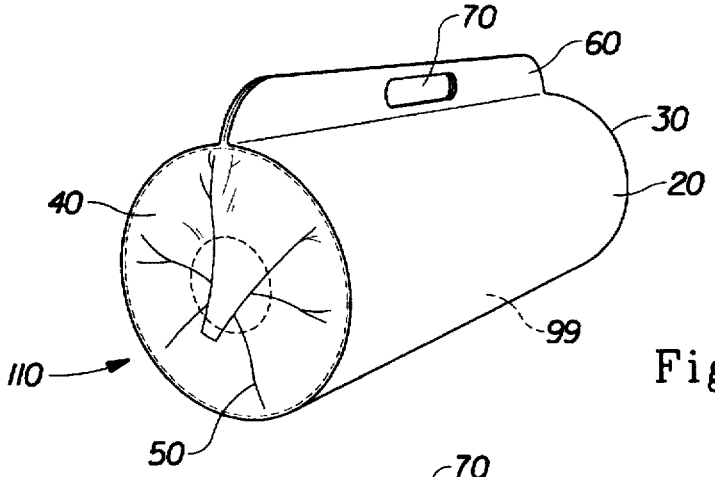
FIG. 2 is a perspective view of another package according to the present invention.
Figure 3:
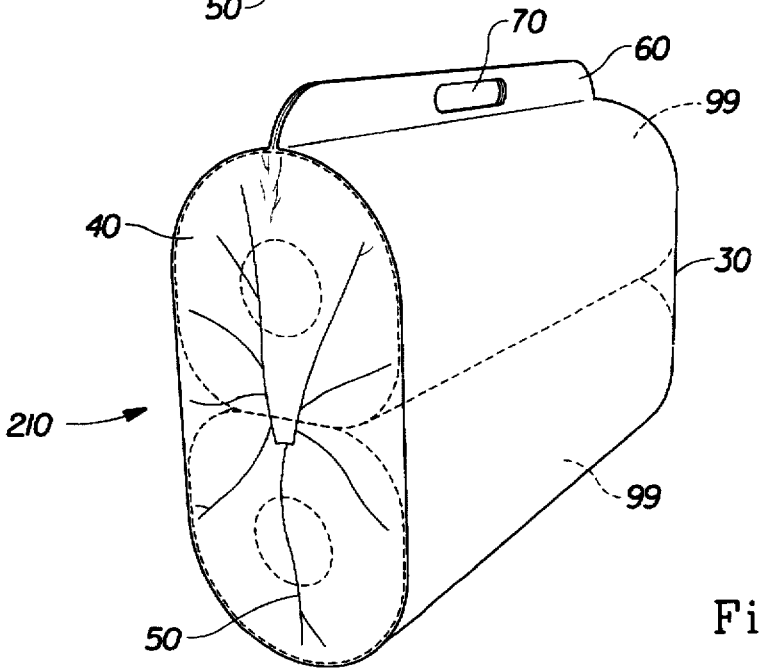
FIG. 3 is a perspective view of yet another package according to the present invention.

FIGS. 2 and 3 depict other representative packages in accordance with the present invention. FIG. 2 depicts a package 110 similar to that of FIG. 1, but with the pleat 60 extending outwardly from the package rather than being folded tangentially to the outer circumference of the sleeve portion 20 and secured thereto. Optionally, a handle 70 or other useful modification may be made to pleat 60. FIG. 3 depicts a multiple product package 210 otherwise similar to that of FIG. 2 containing a plurality of products within a common circumferential sleeve.

As utilized herein, the term "cylindrical" refers to hollow elongated geometrical structures not limited to circular cross-sections but also including elliptical, triangular, quadrilateral, and other polygonal cross-sections. As shown in FIG. 1, a coordinate system may be defined to identify directions and planes within the package/product context. As depicted in FIG. 1, the X direction extends in a direction parallel to the interior of the sleeve (the machine direction during production), while the Y and Z directions are orthogonal thereto. Accordingly, a plane parallel to the Y-Z plane would reveal that the sleeve forms a continuous path around the product(s) within the package in the plane. Accordingly, this continuous path can be utilized to define a circumference of the sleeve, or in other words a perimeter length of this continuous path encircling the product regardless of the cross-sectional shape of the sleeve.

In accordance with the present invention, products are contained within a continuous cylindrical sleeve in a low- or no-tension condition. Products are captured within the sleeve during its formation. The sleeve forms a continuous path encircling the product(s) in at least one plane through the products and package, defining an axial direction normal to the plane and a circumferential direction around the product(s) within the plane. One or more axially-extending pleats are unitarily formed from the material comprising the cylindrical wall of the sleeve, such that the circumference of the cylindrical sleeve is reduced. By reducing the circumference of the cylinder the interior volume of the sleeve, and thus the finished package, is reduced, thus subjecting the products within the package to a compressive force. The compressive force is imparted by a uniform reduction in circumference resulting in a uniform inwardly-directed product compression. Where a single pleat is formed so as to uniformly reduce the circumference of the sleeve, the reduction in circumference is approximately equal to the finished width of the pleat. Multiple pleats multiply the reduction in circumference.

To accomplish the product compression of the present invention in a convenient and economical fashion, the following process of the present invention has been developed. Processes and apparatus have been previously developed for continuously packaging various products such as rolls of paper towels, candy bars, etc. by forming packages from a continuous web of material. The marginal edges of the web are brought together around the product to form an elongated tube around the product which is then severed and sealed between successive products to form discrete packaged products. Such processes are known in the art as "flowrapping" processes. A representative process of this variety is disclosed in U.S. Pat. No. 4,592,193, issued Jun. 3, 1986 to Gustavsson, the disclosure of which is hereby incorporated by reference.

Figure 4:
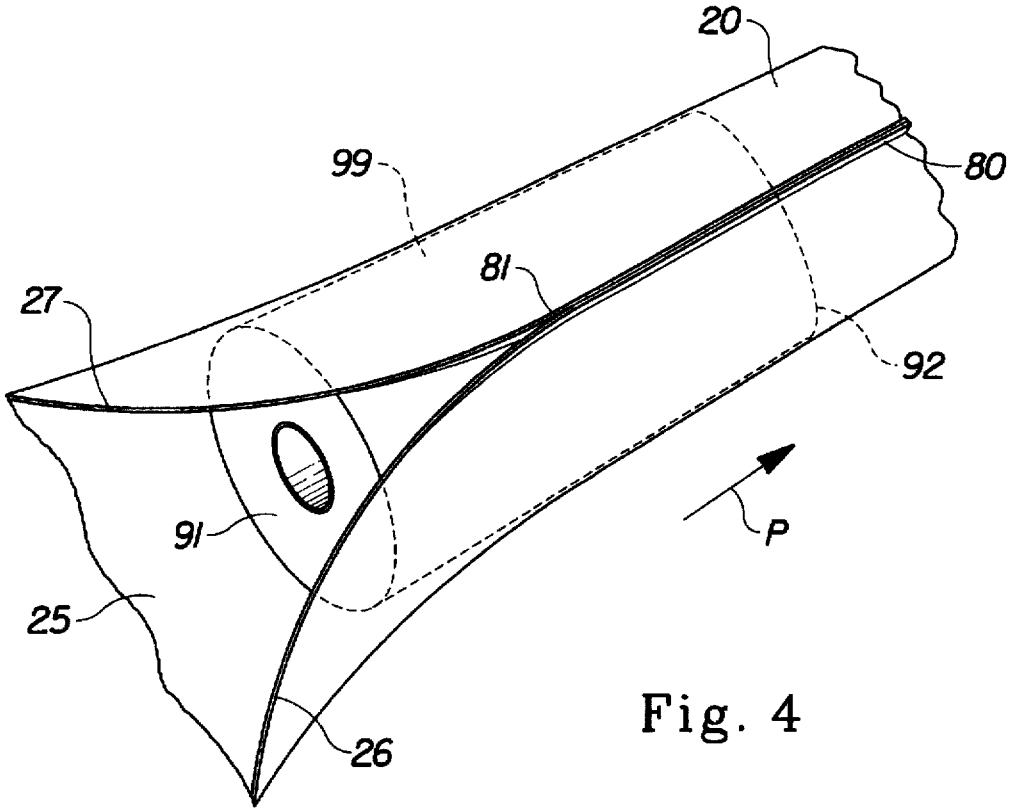
FIG. 4 is a perspective view of the sleeve assembly stage of the process of the present invention.

FIG. 4 depicts a portion of a conventional flowrapping process which forms a point of departure for the process of the present invention. In FIG. 4, a product 99 having a leading end 91 and a trailing end 92, leading and trailing being defined with regard to the direction the product travels (indicated by the arrow "P") during production, is being packaged into a cylindrical tube or sleeve 20 of material such as polymeric film. The film is fed from an unwind roll (not shown) in generally planar form as a web 25 having marginal edges 26 and 27. The web is then guided around or between forms, guides, or shoes such that it assumes a tubular configuration around the product and marginal edges 26 and 27 are brought together at the point 81 and sealed to form a fin seal 80. Fin seal may be formed by heat seals, adhesives, or the like. The sleeve typically has a diameter and circumference approximately equal to that of the product being packaged, such that the product is under low, minimal, or no compressive force and the package sleeve is under low, minimal, or no tension. These tension levels are desirable in terms of minimizing the stress to which the newly-formed fin seal is subjected.

Figure 5:
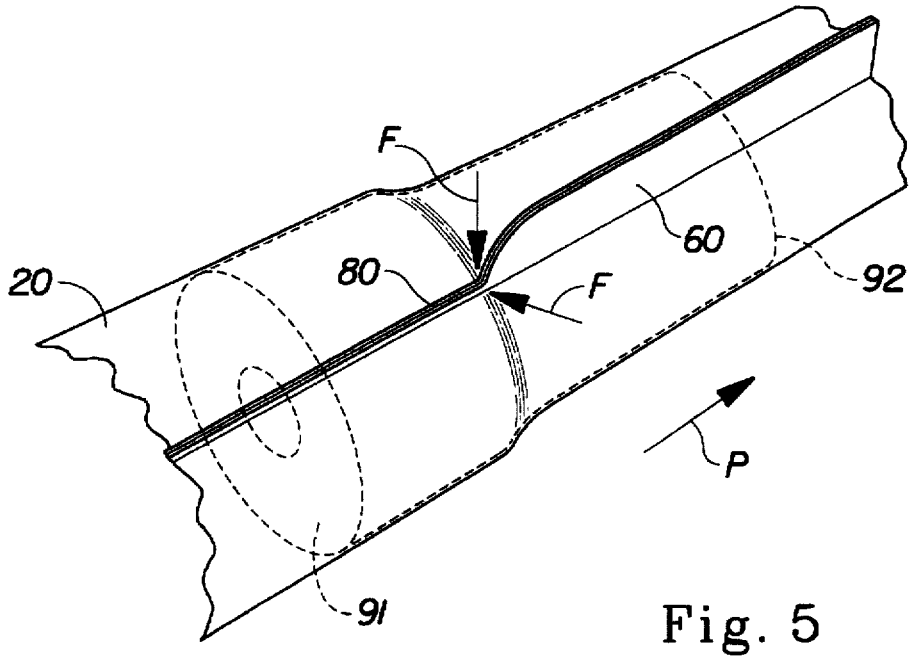
FIG. 5 is a perspective view of the sleeve compression stage of the process of the present invention.

FIG. 5 continues the flowrapping process of FIG. 4 by advancing to the product compression step of the present invention. The package sleeve 80, either in the vicinity of the fin seal 80 as shown or at another circumferential location, is subjected to converging forces (indicated by arrows "F") preferably having both converging tangential force components and at least some level of force component directed inwardly toward the center of the product. These forces may be applied to the sleeved product by wheels, rollers, guides, or other suitable methods. The applied forces form a pleat 60 which reduces the circumference of the sleeve 20 over the product 99 by taking up material previously included in the circumferential length of the sleeve around the product. The lower edge of the pleat 60 where it meets the new circumference may be bonded to itself (i.e., both surfaces of the pleat may be bonded together, including where they meet the new circumference) by adhesives, heat seals, or the like.

Figure 6:
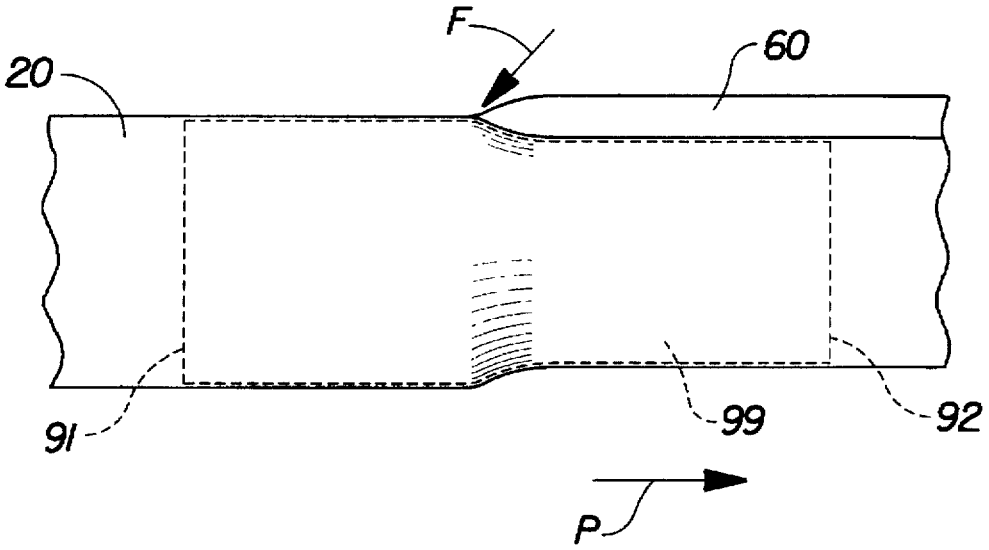
FIG. 6 is an elevational view of the sleeve compression stage of the process of the present invention.
Figure 7:
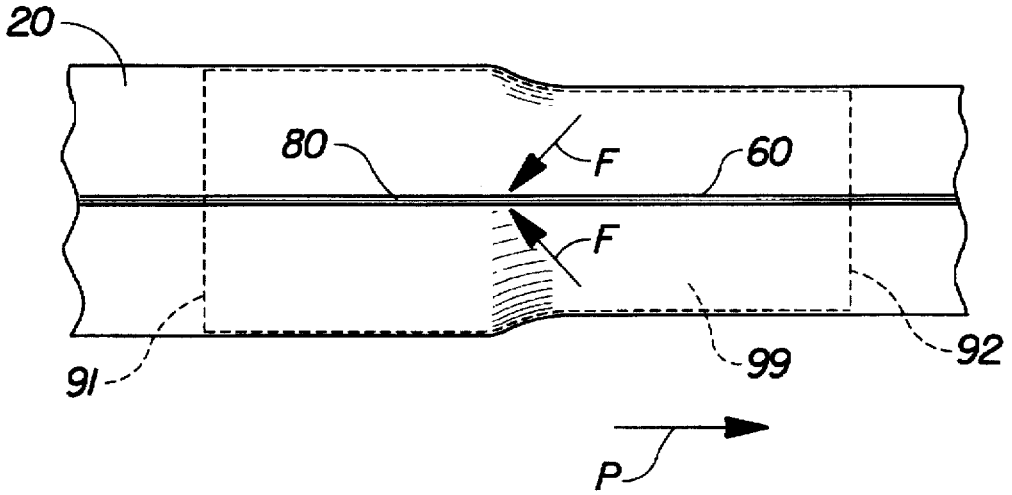
FIG. 7 is a plan view of the sleeve compression stage of the process of the present invention.

As shown in FIG. 5, this reduction in circumference which occurs as the pleat is formed draws the product inwardly toward its axial center and subjects the product to a substantially uniformly distributed compressive force. This serves to reduce the volume of the same given quantity of material for ease of shipping and storage. After the product compression step depicted in FIG. 5 has been accomplished, the sleeve 20 may be severed between sequential products and sealed at the product ends by seals 50 in conventional fashion, such as by adhesives or heat seals. FIGS. 6 and 7 depict elevational and plan views, respectively, corresponding to the process stage of FIG. 5 for additional clarity.

During formation of the pleat, the pleat may be folded over and secured to the sleeve as shown in FIG. 1 for additional pleat sealing integrity and to minimize package dimensions or may be lea extending outwardly from the sleeve and utilized to form a handle 70 or other useful structure as shown in FIGS. 2 and 3.

Multiple pleats may be formed in a single package either sequentially or simultaneously by employing additional sets of apparatus to exert the compressive force. Accordingly, a step-wise increase in product compression may be accomplished by sequential pleating of the sleeve. Alternatively, more than one pleat (such as a pair of pleats) may be formed substantially simultaneously in order to reduce the side of the pleats and better distribute the compressive and tangential forces during formation.

By forming the pleats for product compression after the sleeve has been formed by creation of the fin seal, the integrity of the package will be maintained even in the even of a failure of a pleat since the pleat is unitarily formed from the continuous circumference of the sleeve. Accordingly, even if a pleat becomes "unpleated" the product will experience a loss of compression but still return to its pre-pleated state of enclosure.

It should be understood that, as used herein, the term "product" is intended to encompass not only solid, individual compressible items, but also individual compressible packages which enclose a compressible product or products in liquid, powdered, granular, particulate, or discrete forms. For products in "loose" form such as liquids and particulate materials, suitable means to contain the product during the compression process should be employed to prevent product loss. Accordingly, packages according to the present invention may contain a single individual product, but are particularly suitable for containing a plurality of products which may themselves be packages or carders of individual product units.

Products of particular interest in accordance with the present invention include products which are compressible, i.e., capable of undergoing a reduction in volume and circumference when subjected to external compressive forces. Such products include those which are resiliently compressible, i.e., which return to substantially their original volume and external dimensions when external forces are released. Products of these varieties include disposable diapers, feminine hygiene products, adult incontinence products, paper and tissue products such as paper towels, bathroom tissue, facial tissue, wipes, as well as a wide variety of other products. For illustrative purposes only, a rolled product such as paper towels wound upon a hollow core has been utilized in the Drawing Figures so as to avoid unduly complicating the drawings themselves with product details. The process of the present invention is believed to be particularly advantageous for hollow products, particularly products wound upon a hollow core, since the substantially uniformly exerted compressive force caused by the reduction in circumference of the sleeve may be better withstood by many hollow structures than a directionally-applied force.

The package may be constructed in any desired dimensions, depending upon the particular product or products to be contained therein. More particularly, the proportions of the package may likewise be varied as desired to suit the proportions of the products and the desired overall package shape. The portions of the package providing strength to the package may be altered to provide the desired attributes depending upon the weight of the products to be contained therein, as well as ultimate stacking heights, and other parameters.

Packages in accordance with the present invention may be opened in any suitable manner, such as by the use of externally-applied sharp implements, by tearing the package material, by opening one or more flaps or seams, etc. in any direction desired.

In any packages in accordance with the present invention, including but not limited to those illustrated and specifically described herein, pleats may be secured as has been described but alternatively may be left extending outwardly from the package provided that the pleat sides have been sufficiently secured to one another (or the outer margins of the pleat material where the pleat departs from the circumference of the package) may be secured to one another to maintain pleat geometry and thus the reduction in circumference of the package. Additionally, pleat geometry and construction may be employed to participate in the package opening process by providing that portions of the pleats may be disengaged from one another or from the package so as to release product compression prior to opening of the package, or such that the pleats may provide all or part of the opening feature of the package. Opening features may provide opening of the package in the direction of product compression or otherwise.

Packages in accordance with the present invention may be fabricated from a wide variety of suitable materials including, but not limited to, paper, metal films or foils, and plastic (including polymeric films). For reasons of strength and economy, presently preferred materials for packages according to the present invention include polymeric film.

Suitable means of securing various seams and flaps of such packages, as well as securing volume reducing pleats in their assembled condition, include tape, staples, heat seals, and adhesives, of which heat seals are presently preferred.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A continuous process for packaging products under compression, said process comprising the steps of:

(a) providing a continuous elongated sheet of material having two marginal edges;

(b) providing a compressible product;

(c) forming said sheet of material into a cylindrical sleeve around said product by joining said marginal edges to one another to form a fin seal, said sleeve defining an axial direction parallel to said marginal edges and a circumference measured in a plane passing through said product in a direction normal to said axial direction;

(d) reducing said circumference of said sleeve to impart compression to said product by forming at least one axially-extending pleat in said sleeve; and (e) repeating steps (a) through (d) for successive products.

2. The process of claim 1, wherein said sheet of material comprises a polymeric film.

3. The process of claim 1, further comprising the step of folding said pleat tangentially to said sleeve and bonding said pleat to said sleeve.

4. The process of claim 1, wherein said pleat is formed by applying converging forces to said sleeve over said product.

5. The process of claim 4, wherein said converging forces are applied via rollers.

6. The process of claim 1, wherein said pleat includes said fin seal.

7. The process of claim 1, further comprising the step of further reducing said circumference of said sleeve by forming a second axially-extending pleat in said sleeve.

8. The process of claim 1, wherein multiple compressible products are provided substantially simultaneously such that said sleeve encircles multiple products.

9. The process of claim 1, further comprising the step of severing said sleeve between successive products and forming seals adjacent ends of said product.

10. The process of claim 1, wherein said product comprises a hollow or cored product.

11. The process of claim 1, wherein said product comprises a roll of paper towels.

12. The process of claim 1, wherein said step of reducing said circumference of said sleeve is accomplished by substantially simultaneously forming two axially-extending pleats in said sleeve.

13. The process of claim 1, wherein said sleeve has a circular cross-section.

14. The process of claim 1, wherein said sleeve has a quadrilateral cross-section.

15. A package suitable for enclosing and containing one or more compressible products made in accordance with the process of claim 1.

16. A package suitable for enclosing and containing one or more compressible products made in accordance with the process of claim 3.

17. A continuous process for packaging products under compression, said process comprising the steps of:

(a) providing a continuous elongated sheet of material having two marginal edges;

(b) providing a compressible product;

(c) forming said sheet of material into a cylindrical sleeve around said product by joining said marginal edges to one another to form a fin seal, said sleeve defining an axial direction parallel to said marginal edges and a circumference measured in a plane passing through said product in a direction normal to said axial direction;

(d) reducing said circumference of said sleeve to impart compression to said product by forming a first axially-extending pleat in said sleeve;

(e) further reducing said circumference of said sleeve to impart compression to said product by forming a second axially-extending pleat in said sleeve; and (f) repeating steps (a) through (e) for successive products.

18. A package suitable for enclosing and containing one or more compressible products made in accordance with the process of claim 17.

19. A continuous process for packaging products under compression, said process comprising the steps of:

(a) providing a continuous elongated sheet of polymeric film material having two marginal edges;

(b) providing a compressible product;

(c) forming said sheet of material into a cylindrical sleeve around said product by joining said marginal edges to one another via heat sealing to form a fin seal, said sleeve defining an axial direction parallel to said marginal edges and a circumference measured in a plane passing through said product in a direction normal to said axial direction;

(d) reducing said circumference of said sleeve to impart compression to said product by forming at least one axially-extending pleat in said sleeve by exerting converging tangential forces on said sleeve over said product; and (e) repeating steps (a) through (d) for successive products.

20. A package suitable for enclosing and containing one or more compressible products made in accordance with the process of claim 19.

* * * * *